US008172283B2

(12) United States Patent
Takahashi et al.

(10) Patent No.: US 8,172,283 B2
(45) Date of Patent: May 8, 2012

(54) DOOR LATCH DEVICE IN A MOTOR VEHICLE

(75) Inventors: Akira Takahashi, West Bloomfield, MI (US); Bryan Farris, Livonia, MI (US)

(73) Assignee: Mitsui Kinzoku Act Corporation (JP)

( * ) Notice: Subject to any disclaimer, the term of this patent is extended or adjusted under 35 U.S.C. 154(b) by 546 days.

(21) Appl. No.: 12/411,747

(22) Filed: Mar. 26, 2009

(65) Prior Publication Data

US 2009/0243309 A1 Oct. 1, 2009

(30) Foreign Application Priority Data

Mar. 28, 2008 (JP) ..... 2008-85686

(51) Int. Cl.
*E05C 3/06* (2006.01)

(52) U.S. Cl. ..... 292/201; 292/216; 292/DIG. 23

(58) Field of Classification Search ..... 292/201, 292/216, DIG. 23
See application file for complete search history.

(56) References Cited

U.S. PATENT DOCUMENTS 6,371,538 B1 * 4/2002 Inoue ..... 292/216
2009/0241617 A1 * 10/2009 Takahashi et al. ..... 70/257
2009/0243309 A1 * 10/2009 Takahashi et al. ..... 292/201

FOREIGN PATENT DOCUMENTS

JP 9-195601 A 7/1997
JP 3400747 B 2/2003

* cited by examiner

*Primary Examiner* — Kristina Fulton
(74) *Attorney, Agent, or Firm* — Ostrolenk Faber LLP

(57) ABSTRACT

A door latch device in a motor vehicle comprises an engagement portion which can engage with a striker of a vehicle body; an operating lever operated with a handle on a door of the vehicle to open the door; a locking lever which moves between an unlocking position where the engagement portion can be disengaged from the striker and a locked position where the engagement portion cannot be disengaged from the striker; a first subsidiary lever moving with the locking lever; a second subsidiary lever connected to the operating lever and moving with the first subsidiary lever; a spring exerting a force to the first subsidiary lever and the second subsidiary lever; and a blocking member moving between a blocking position and an unblocking position. When the blocking member is in the blocking position, a locking knob is actuated for unlocking to allow the locking lever and the first subsidiary lever to move from the locked position to the unlocking position against a force of the spring.

6 Claims, 8 Drawing Sheets

DOOR LATCH DEVICE IN A MOTOR VEHICLE

BACKGROUND OF THE INVENTION

The present invention relates to a door latch device in a motor vehicle.

In a door latch device in a motor vehicle of JP9-195601A, in order not to shift a locking mechanism to an unlocking state by wrongfully unlocking a locking knob of a door inside the vehicle a force transmitting path between the locking knob and a locking lever is cut off to make a double locking state not to allow unlocking of the locking knob to be transmitted to the locking lever.

In JP3400747B, a blocking member is moved from an unblocking position to a blocking position by a double-locking motor to prevent a locking lever from moving to the unlocking position, thereby inhibiting unlocking of a locking knob.

However, in the former, it is necessary to provide a swinging member in a force transmitting path in order not to transmit unlocking of the locking knob to the locking lever. So the structure becomes more complicated.

In the latter, in order to prevent the locking lever from moving to the unlocking position, if the locking knob is forcedly unlocked wrongfully, a force transmitting path between the locking knob and locking lever will be likely to be deformed. If strength is not enough, wrong action cannot be prevented.

SUMMARY OF THE INVENTION

In view of the foregoing disadvantages in the prior art, it is an object of the invention to provide a door latch device in a motor vehicle, the device being simple in structure, illegal action being prevented without fail

BRIEF DESCRIPTION OF THE DRAWINGS

The features and advantages of the invention will become more apparent from the following description with respect to an embodiment as shown in accompanying drawings.

DETAILED DESCRIPTION OF PREFERRED EMBODIMENT

Figure 2:
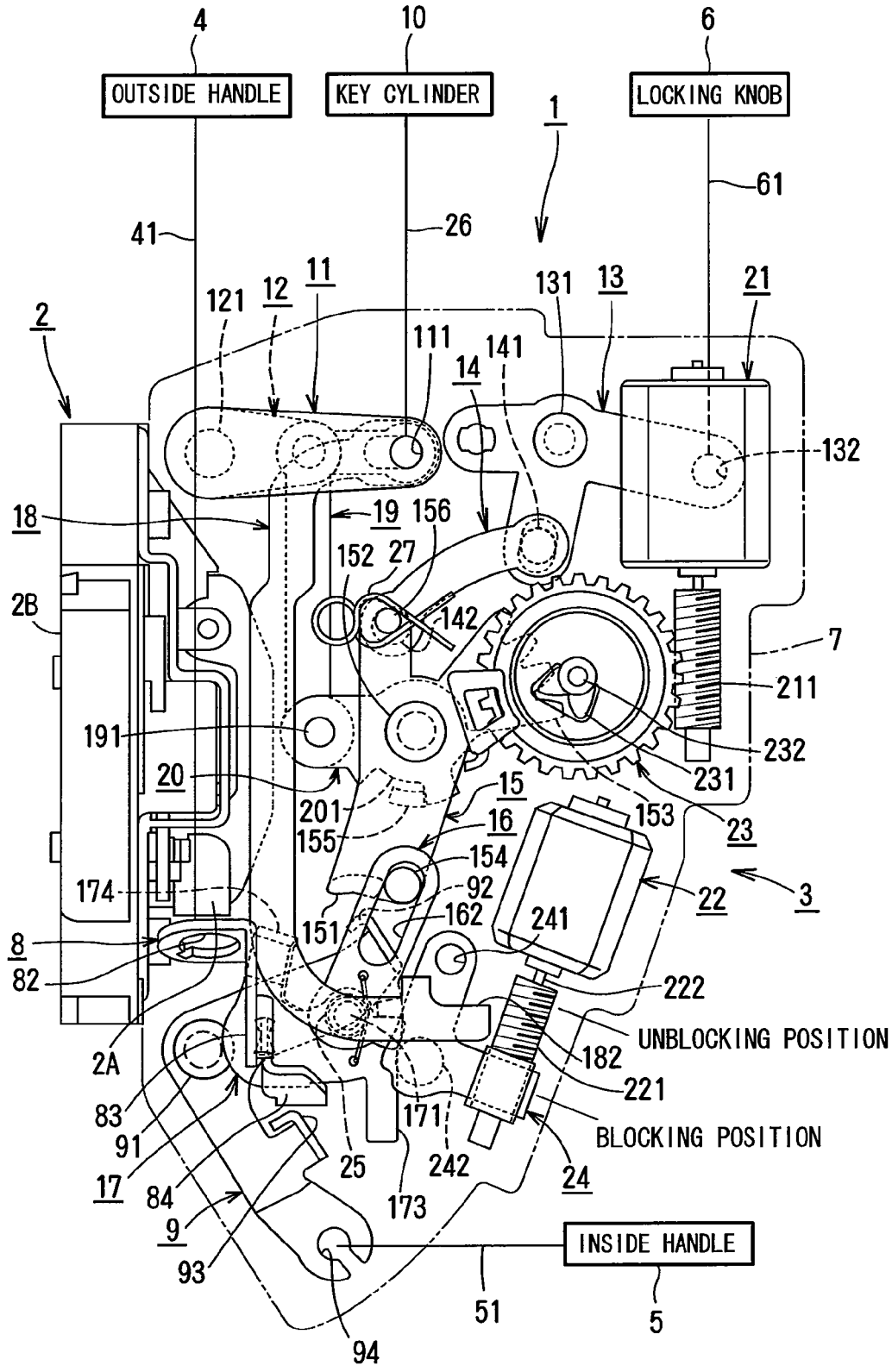
FIG. 2 is a front elevational view of the door latch device in a double-locking state.

The right side in FIG. 2 and the left side in FIGS. 3-8 are a front of a motor vehicle, and the left side in FIG. 2 and the right side in FIGS. 3-8 are a rear. The front in FIG. 2 and the back in FIGS. 3-8 are outside of the vehicle, and the back in FIG. 2 and the front in FIGS. 3-8 are inside thereof.

A door latch device 1 is disposed at the rear end of a front door of a motor vehicle, and comprises an engagement portion 2 for holding the door in a closed position and an operating portion 3 for operating the engagement portion 2.

In FIG. 2, the door latch device 1 comprises the structure that changes among an unlocking state where the door can be opened with an outside handle 4 outside the vehicle or an inside handle 5 inside the vehicle; a locked state where the door cannot be opened with the outside handle 4, but can be opened by double actions with the inside handle 5; and a double-locked state where the door cannot be opened with the outside handle 4 or inside handle 5 by invalidating the double actions of the inside handle 5 and unlocking of an unlocking knob 6 inside the car. The double action of the inside handle comprises a first action in which the operating portion 3 changes from the locked condition to the unlocking condition and a second action in which the engagement portion 2 is released.

The engagement portion 2 comprises a body 2B fixed to the rear end in the door with a plurality of bolts (not shown); a latch (not shown) pivotally mounted in the body 2B to engage with a striker (not shown) fixed to a vehicle body; a ratchet (not shown) pivotally mounted in the body 2B to engage with the latch; and an opening lever 2A which can rotate with the ratchet. When the door is closed, the striker engages with the latch while the ratchet engages with latch to prevent the latch from turning in an opening direction to keep the door closed. The opening lever 2A turns in a releasing direction A in FIG. 1 to release the ratchet from the latch, enabling the door to open. The engagement portion 2 is known and does not relate to the present invention. Thus, its detailed description is omitted.

Figure 1:
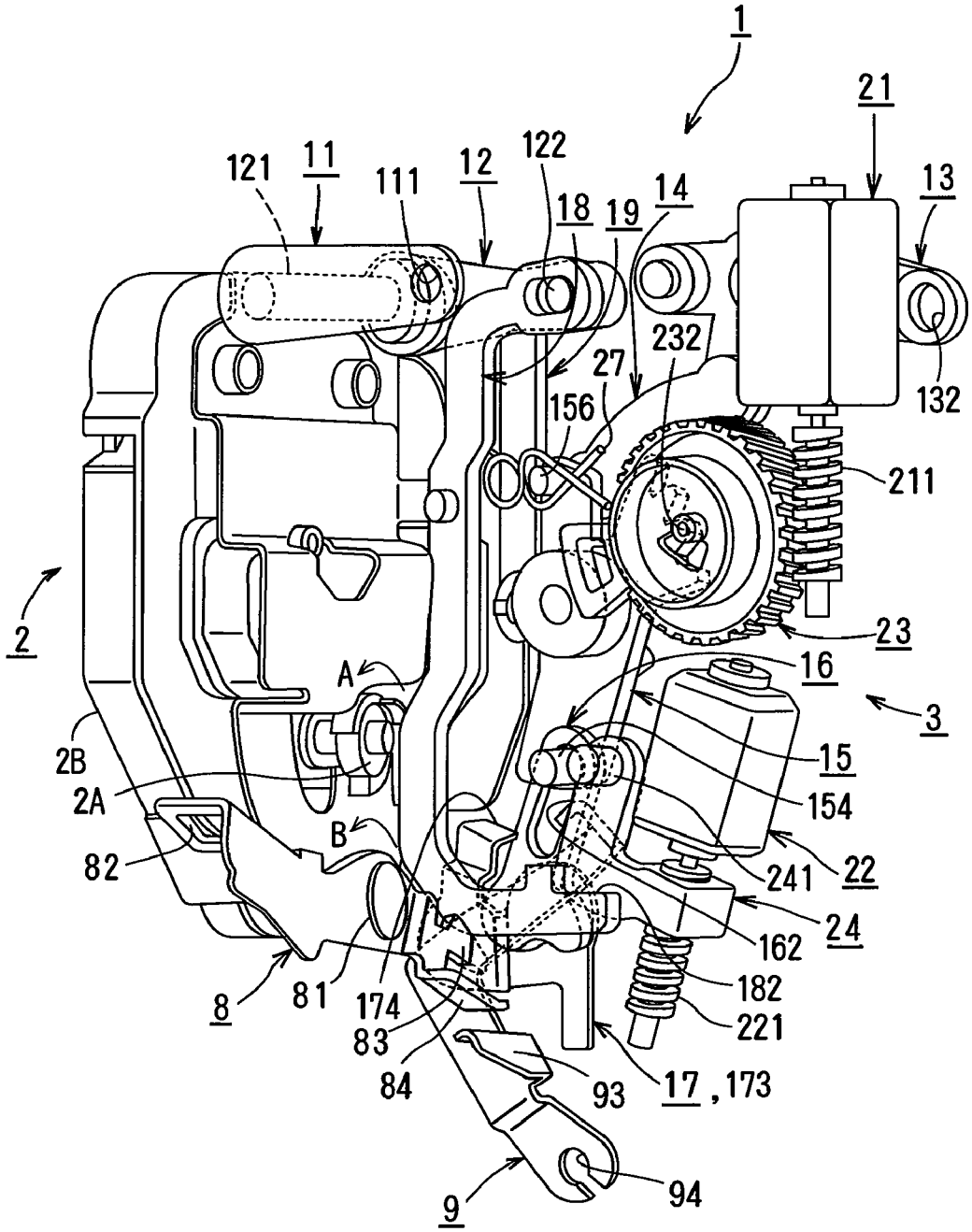
FIG. 1 is a perspective view of a door latch device according to the present invention.

A synthetic resin cover 7 is mounted over the front face of the body 2B, but is omitted in FIG. 1 to show the operating portion 3 in the cover 7.

The operating portion 3 comprises an outer lever 8 connected to the outside handle 4 via a rod 41 for transmitting a working force; an inner lever 9 connected to the inside handle 5 via a cable 51; first and second key levers 11,12 moving with a key cylinder 10 outside the vehicle body; a first locking lever 13 moving with the locking knob 6; a second locking lever 15 connected to the first locking lever 13 via a link 14; a first subsidiary lever 16 connected to the second locking lever 15; a second subsidiary lever 17 connected to the outer lever; first and second sliding links 18, 19 moving with the first and second key lever 11.12; a third key lever 20 moving with the second sliding link 19; a locking motor 22; a double-locking or blocking motor 22; a worm wheel 23 driven by the motor 21; and a blocking member 24 driven by the double-locking motor 22.

The outer lever 8 is pivotally mounted on a pivot shaft 81 at the lower end of the cover 7 in FIG. 1. With door-opening operation of the outside handle 4, the outer lever 8 turns in a releasing direction shown by an arrow B in FIG. 1 against the force of a spring (not shown). To a link 82 at the outer side end of the outer lever 8, is coupled the lower end of the rod 41 the upper end of which is coupled to the outside handle 4. The second subsidiary lever 17 is coupled to the inner side end 83 to turn at a certain angle in a forward and rearward direction.

The inner lever 9 is pivotally mounted on a pivot shaft 91 extending transversely of the vehicle at the lower part of the cover 7 and comprises at the upper part an unlocking-contact portion 92 which can bring in contact with an unlocking-contact portion 151 (later described) of a second locking lever 15. The inner lever 9 comprises at the lower part a contact portion 93 which can contact a bent portion 84 of the outer lever 8. Below the contact portion 93, there is provided a link 94 coupled to the other end of a cable 51 one end of which is coupled to the inside handle 5.

Figure 3:
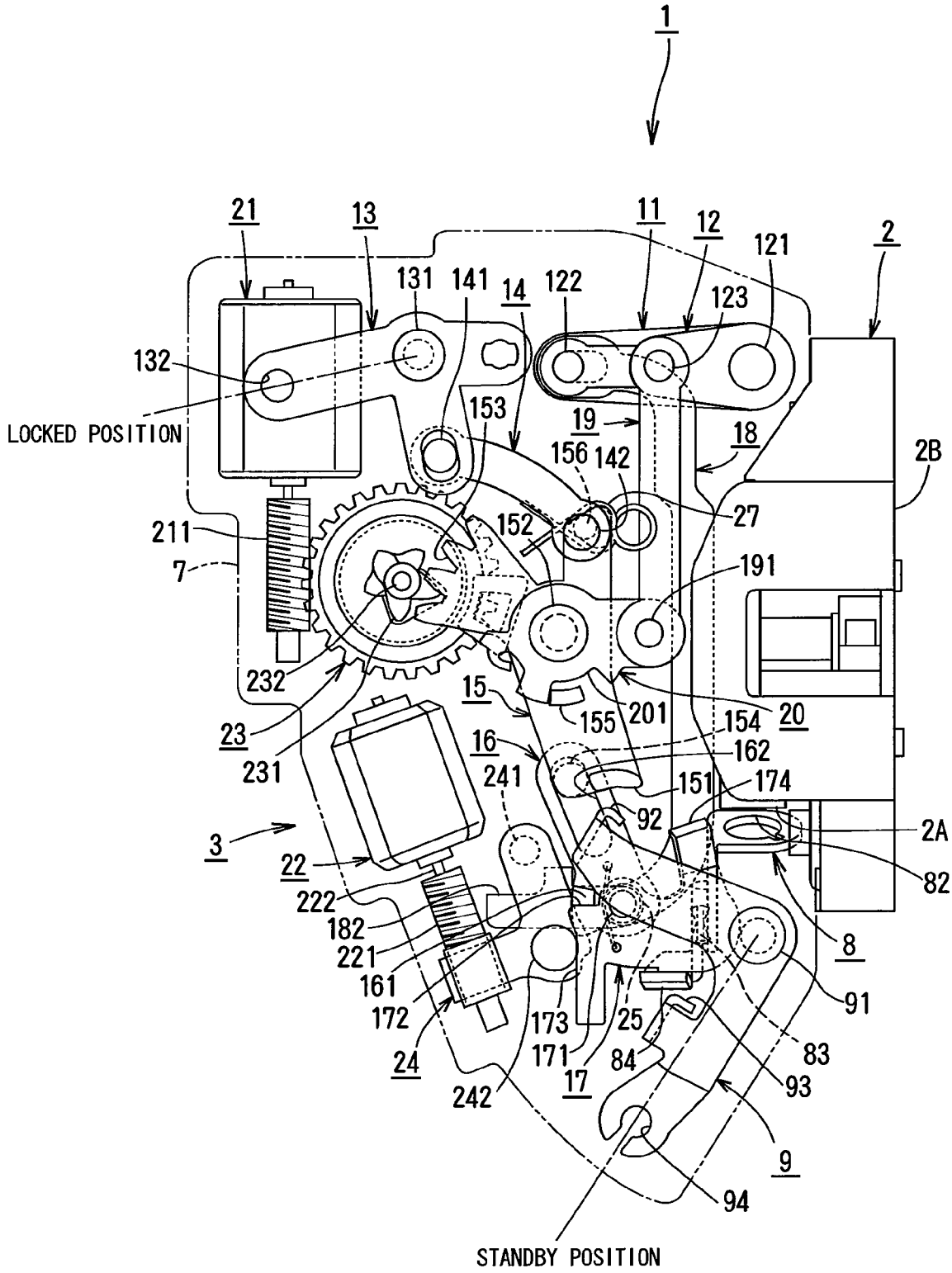
FIG. 3 is a rear elevational view of the door latch device in the double-locking state.
Figure 5:
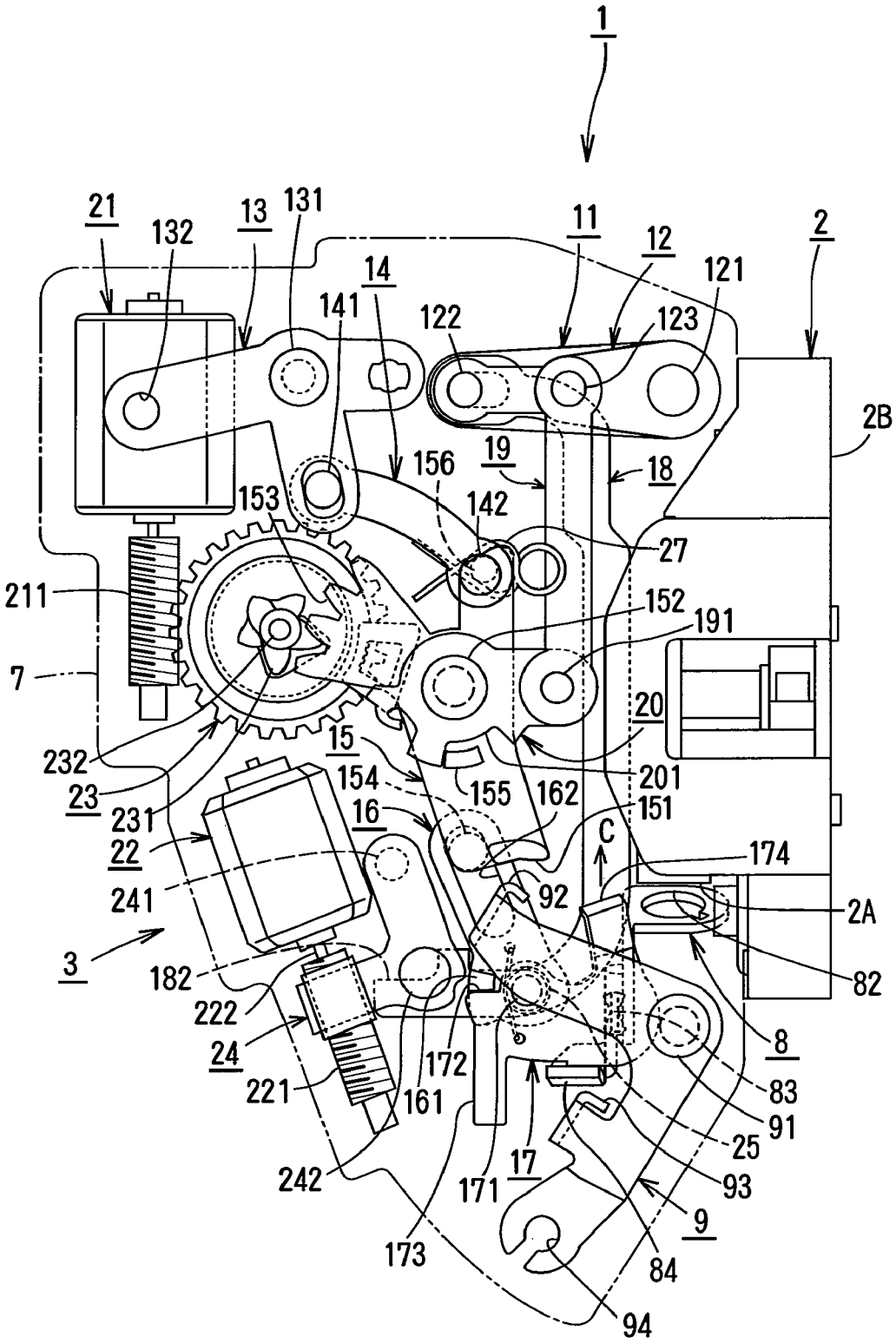
FIG. 5 is a rear elevational view of the door latch device in a locked state.
Figure 6:
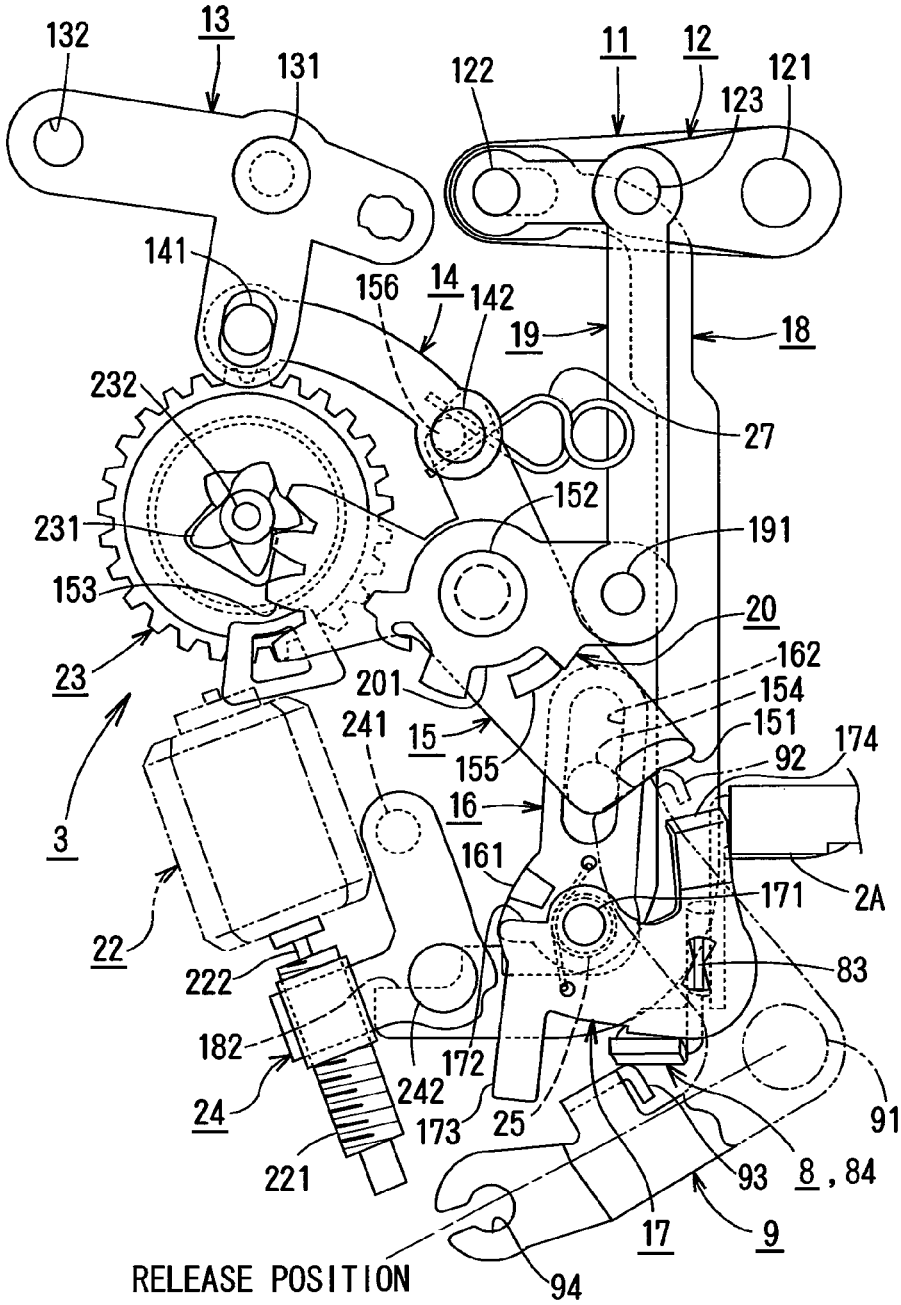
FIG. 6 is a rear elevational view of the door latch device in the locked state.
Figure 7:
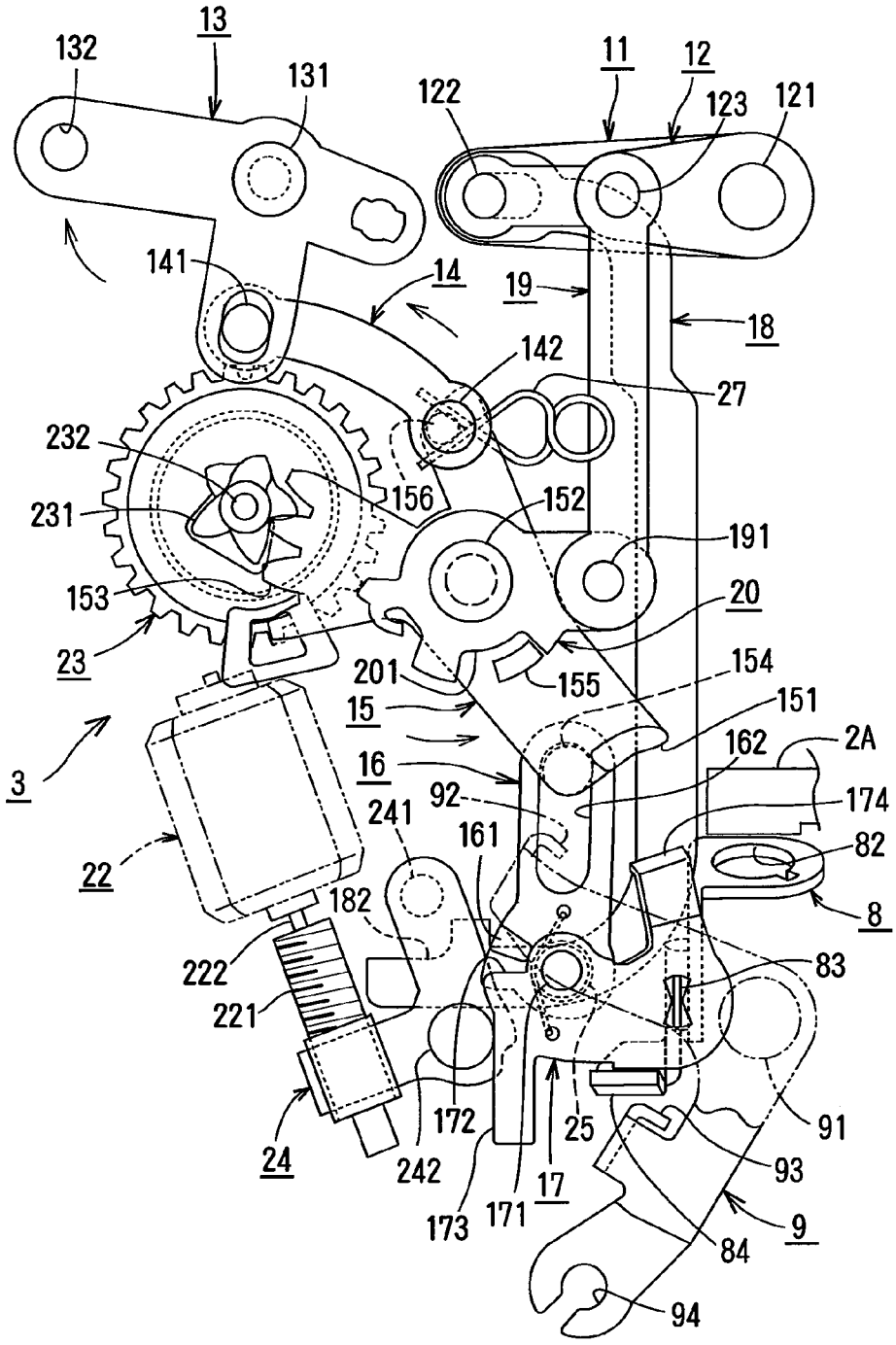
FIG. 7 is a rear elevational view thereof when a locking knob is unlocked in the double-locking state.

In order that the door may be opened with the inside handle, the inner lever 9 turns on the pivot shaft 91 in a releasing direction anticlockwise in FIG. 2 or clockwise in FIG. 3 from a standby position in FIGS. 2 and 3 to a releasing position in FIG. 6. When the inner lever 9 turns in the releasing direction, the contact portion 93 of the inner lever 9 comes in contact with the bent portion 84 of the outer lever 8 to allow the outer lever 8 to turn in a releasing direction The first locking lever 13 is pivotally mounted on a pivot shaft 131 extending transversely of the vehicle at the upper part of the cover 7, and is movable between an unlocking position in FIGS. 4, 6, 7 and 8 and a locked position in FIGS. 2, 3 and 5. A link 132 at the rear end of the first locking lever 13 is connected to the locking knob 6 via a rod 61. The lower end of the first locking lever 13 is rotatably coupled to a shaft 141 of the link 14.

Figure 4:
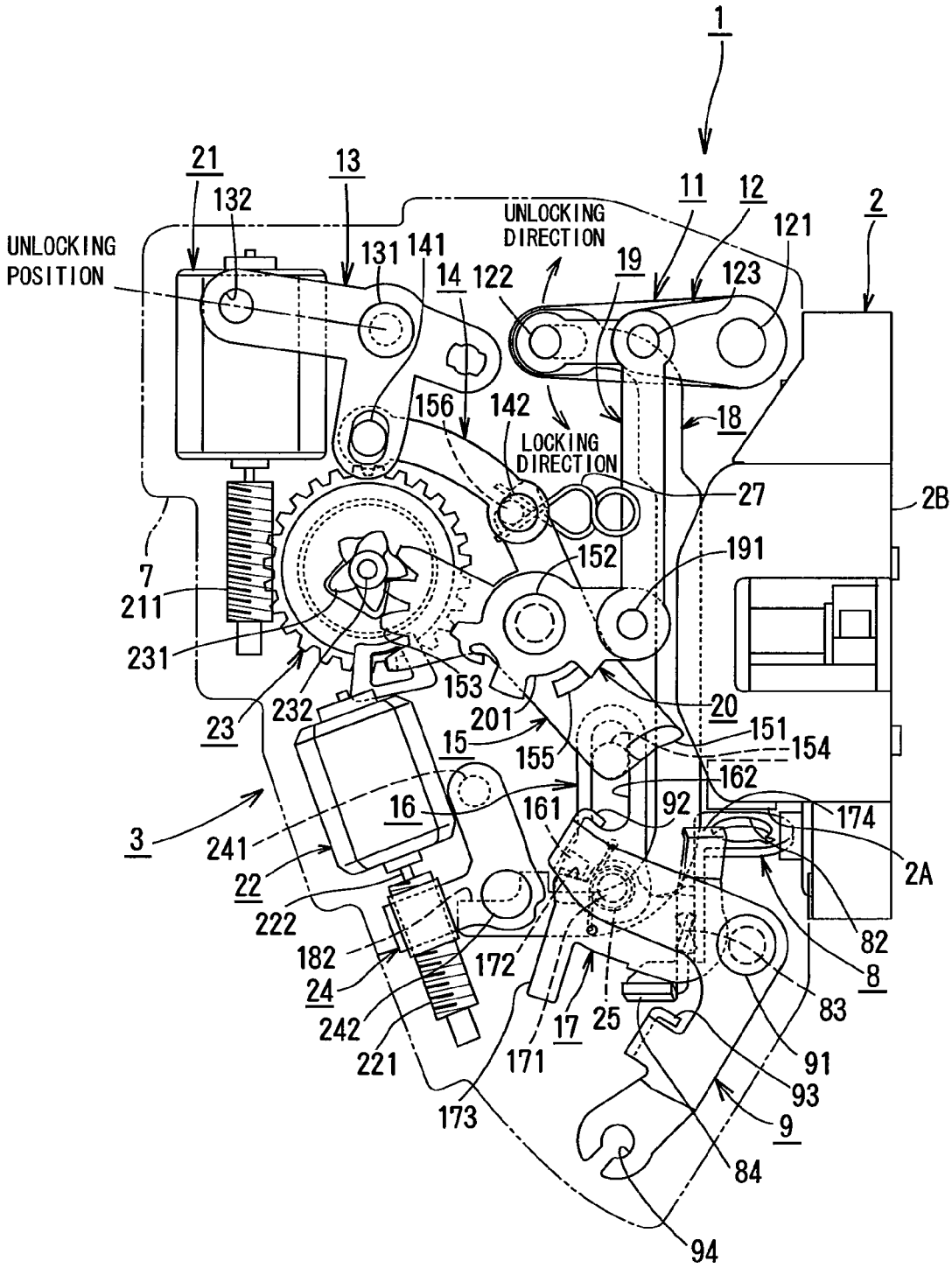
FIG. 4 is a rear elevational view of the door latch device in an unlocking state.

The second locking lever 15 is pivotally mounted to the cover 7 on a pivot shaft 152 extending transversely of the vehicle, and is movable between the unlocking position in FIGS. 4, 6, 7 and 8 and the locked position in FIGS. 2, 3 and 5. A projection 156 of the second locking lever 15 elastically engages with an elastically holding member 27 such as a spring on the cover 7 to allow the second locking lever 15 to be held with a predetermined elastic force in the unlocking or locked position. The force of the elastically holding member 27 is set to be greater than that of a spring 25 acting between the first subsidiary lever 16 and the second subsidiary lever 17. The spring 25 will be described later.

A sector gear 163 on the front periphery of the second locking lever 15 meshes with a smaller-diameter teeth 231 of a worm wheel 23. The upper end of the second locking lever 15 is pivotally coupled to a shaft 142 at the lower part of the link 14 to allow the second locking lever 15 to be connected to the first locking lever 13. A projection 154 at the lower end of the second locking lever 15 is in sliding engagement with a slot 162 of the first subsidiary lever 16. The unlocking-contact portion 151 projects on the surface opposite the second locking lever 15 so as to contact the unlocking-contact portion 92 of the inner lever 9.

The worm wheel 23 is pivotally mounted to the cover 7 on a pivot shaft 232 extending transversely of the cover 7; meshes with a worm 211 on an output shaft of a locking motor 21 and is forced with a neutral-position-returning spring (not shown) provided on the cover 7. The worm wheel 23 reversibly meshes with the worm 211.

When the locking motor 21 turns in the unlocking direction, the worm wheel 23 turns at a predetermined angle against force of the neutral-position-returning spring from a neutral position in the unlocking direction clockwise in FIG. 3. With stop of the locking motor 21, the worm wheel 23 returns to the neutral position by force of the neutral-position-returning spring. When the locking motor 21 turns in the locking direction, the worm wheel 23 turns at a predetermined angle against the force of the neutral-position-returning spring in the locking direction or anticlockwise in FIG. 4. With the rotation the second locking lever 15 turns from the unlocking position to the locked position. Thereafter, with stop of the locking motor 21, the worm wheel 23 returns to the neutral position by force of the neutral-position-returning spring. The teeth 231 of the worm wheel 23 mesh with the sector gear 153 of the second locking lever 153 such that the second locking lever 15 does not move with returning rotation of the worm wheel 23 when the worm wheel 23 returns to neutral position by force of the neutral-position-returning spring.

When the locking knob 6 is actuated for locking from the unlocking position, the first locking lever 13 turns on the pivot shaft 131 from the unlocking position to the locked position, and the second locking lever 15 which moves together with the first locking lever 13 via the link 14 turns on the pivot shaft 152 from the unlocking position to the locked position. When the locking knob 6 is actuated for unlocking from the locked position, the first locking lever 13 turns on the pivot shaft 131 from the locked position to the unlocking position, and the second locking lever 5 which moves together with the first locking lever 13 via the link 14 turns on the pivot shaft 152 from the locked position to the unlocking position. Furthermore, when the locking motor 21 drives in the locking direction, the second locking lever 15 turns from the unlocking position to the locked position with rotation of the worm wheel 23. The first locking lever 13 which moves together with the second locking lever 15 via the link 14 turns from the unlocking position to the locked position. When the locking motor 21 drives in the unlocking direction, the second locking lever 15 turns from the locked position to the unlocking position with the rotation of the worm wheel 23, and the second locking lever 13 which moves together with the second locking lever 15 via the link 14 turns from the locked position to the unlocking position.

The first key lever 11 and second key lever 12 are pivotally mounted on a pivot shaft 121 extending transversely of the vehicle at the upper part of the cover 7 so that they can turn together. A link 111 at the front end of the fist key lever 11 is connected to a key cylinder 10 via a rod 26. By the key cylinder 10, the first and second key levers 11,12 turns at a predetermined angle in the unlocking direction anticlockwise in FIG. 2 and clockwise in FIG. 3 and in the locking direction clockwise in FIG. 2 and anticlockwise in FIG. 3 from the neutral position in FIGS. 2 and 3.

The second key lever 12 is pivotally mounted on shafts 122,123 to the upper ends of the first sliding link 18 and second sliding link 19 supported by the cover 7 respectively to slide up and down.

Figure 8:
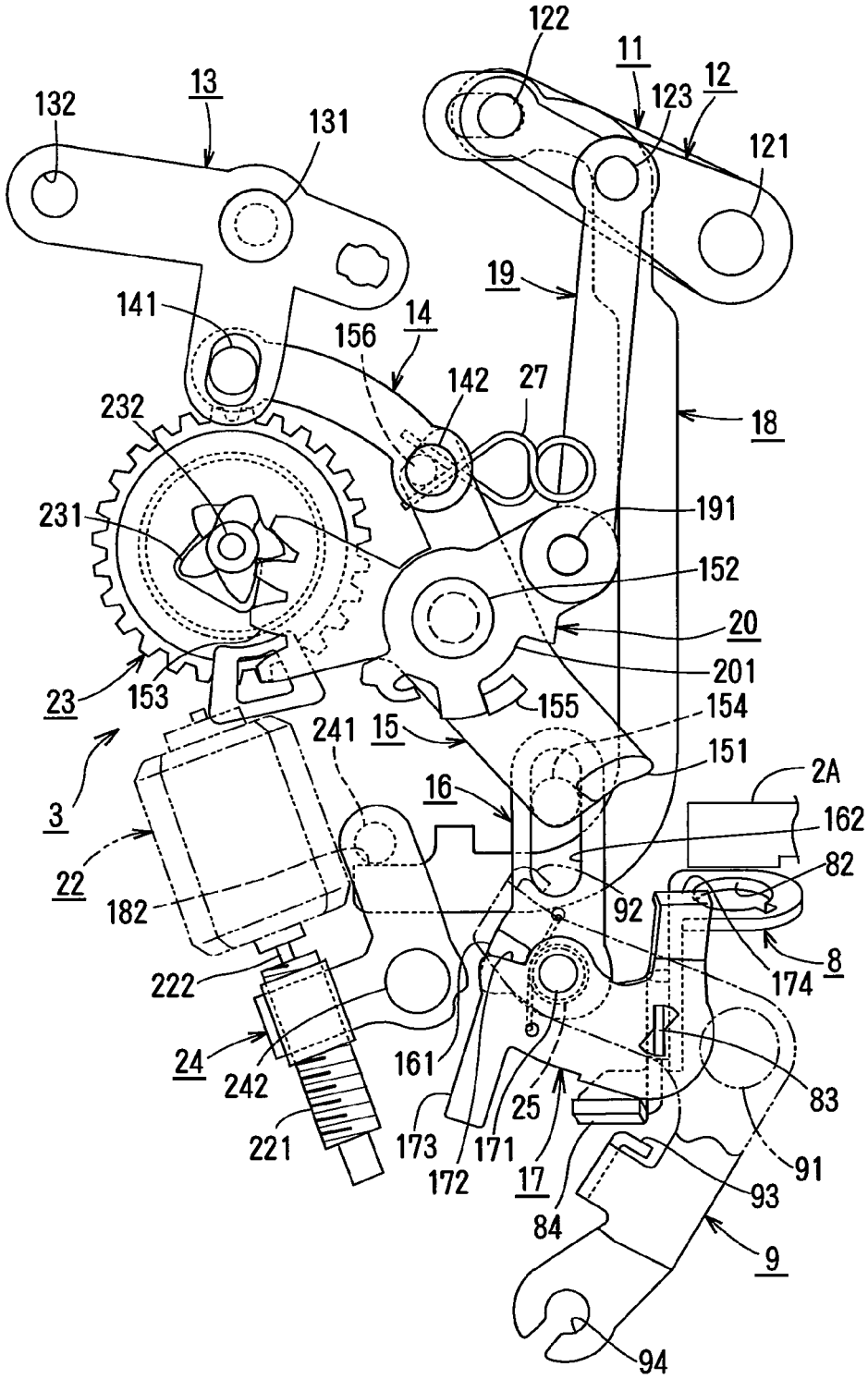
FIG. 8 is a rear elevational view when a key cylinder is unlocked.

The third key lever 20 is pivotally mounted on a pivot shaft 152 so as to turn separately from the second locking lever 15, and can turn from the neutral position in FIGS. 2-7 to the unlocking position in FIG. 8 and from the neutral position to a locked position (not shown) at a predetermined angle clockwise in FIG. 3. On the outer periphery of the third key lever 20, there is a notch 201 which is adapted to engage with a projection 155 on the second locking lever 15 with a play corresponding to a stroke during unlocking. When the third key lever 20 moves from the neutral position to the unlocking position, one edge of the notch 201 in contact with the projection 155 on the second locking lever 15 to allow the second locking lever 15 to move to the unlocking position. Meanwhile, when the third key lever 20 moves from the neutral position to the locked position, the other edge of the notch 201 comes in contact with the projection of the second locking lever 15 to allow the second locking lever 15 to move to the locked position.

The first sliding link 18 is coupled at the upper end to the shaft 122 of the second key lever 12 to move up and down with movement of the first and second key levers 11, 12. The first sliding link 18 has at the lower end an engagement portion 182 which can contact an unblocking-contact portion 241 of a blocking member 24. With unlocking of the key cylinder 10, the first sliding link 18 moves in an unlocking direction upward in each figure to the unlocking position in FIG. 8, so that the engagement portion 182 comes in contact with the unblocking-contact portion 241 to allow the blocking member 24 from a blocking position to an unblocking position.

The second sliding link 19 is joined at the upper end to the second key lever 12 with the shaft 123, and is pivotally joined at the lower end to the third key lever 20 on the shaft 191. With unlocking operation of the key cylinder 10, the second sliding link 19 is moved in the unlocking direction upward from the neutral position in FIGS. 2-7 to the unlocking position in FIG. 8 to allow the third key lever 20 to move to the unlocking position. With locking operation of the key cylinder 10, the second sliding link 19 is moved in the locking direction downward from the neutral position to the locked position (not shown) to allow the third key lever 20 to move to the locked position.

The second subsidiary lever 17 is pivotally mounted to the inner side end 83 of the outer lever 8 and is movable between the unlocking position in FIGS. 4 and 8 and the locked position in FIGS. 2, 3, 5 and 78 by the locking knob 6, key cylinder 10 and locking motor 21 when the outer lever 8 is in the standby position and is not in the double-locking state. Thus, when the outer lever 8 turns in a releasing direction, the second subsidiary lever 17 moves upward for releasing while it is still kept in the unlocking or locked position. The key cylinder 10 allows the second subsidiary lever 17 to move to the unlocking state despite double locking.

The second subsidiary lever 17 has at the front end a blocked portion 173 which comes in contact with a blocking portion 242 of the blocking member 24 moved to a blocking position when the second subsidiary lever 17 is in the locked position. At the upper rear end of the second subsidiary lever 17, there is a releasing-contact portion 174 which comes in contact with the opening lever 2A when the second subsidiary lever 17 is in the unlocking position, and which does not come in contact with the opening lever 2A when it is in the locked position.

The blocked portion 173 of the second subsidiary lever 17 can contact the blocking portion 242 of the blocked portion 173 from a direction perpendicular to a moving direction of the blocking member 24. Thus, the blocked portion 173 contacts the blocking portion 242, so that the second subsidiary lever 17 is bound in the locked position not to move to the unlocking position.

The second subsidiary lever 17 in the unlocking position moves upward when the outer lever 7 moves in a releasing direction to allow the releasing-contact portion 174 to contact the opening lever 2A thereby disengaging the ratchet from the latch. In the locked position, even if it is released, the releasing-contact portion 174 swings with respect to the opening lever 2A making it impossible for the opening lever 2A to turn in the releasing direction, so that the ratchet cannot engage from the latch.

The first subsidiary lever 16 is pivotally mounted on a shaft 171 to the front part of the second subsidiary lever 17 on a shaft 171. In the slot 162, the projection 154 of the second locking lever 15 slidably engages. Around the shaft 171 of the first subsidiary lever 16, there is provided an engagement portion 161 which engages in an engagement portion 172 of the second subsidiary lever 17.

On the shaft 171, a spring 25 is wound. One end of the spring 25 is secured to the first subsidiary lever 16, while the other end is secured to the second subsidiary lever 17. Force of the spring 25 acts onto the first subsidiary lever 16 such that the engagement portion 161 contacts the engagement portion 172 of the second subsidiary lever 17 to keep the first subsidiary lever 16 in a normal position in FIGS. 2-5 and 8 where the engagement portion 161 contacts the engagement portion 172. In non-double-locking condition or normally, the first subsidiary lever 16 and second subsidiary lever 17 are movable together between the unlocking position and the locked position. In double-lock condition, even if the second subsidiary lever 17 is held in the locked position, only the first subsidiary lever 16 is able to turn against the force of the spring 25 from a normal position to the unlocking position in FIG. 7

The blocking member 24 is supported to slide up and down at the lower part of the cover 7 and engages with a spiral teeth 221 on an output shaft 222 of a double-locking motor 22. With the rotation of the double-locking motor 22, the blocking member 24 moves along the output shaft 222 between an unblocking position in FIGS. 4-6 and 8 and a blocked position in FIGS. 2, 3 and 7. When the blocking member 24 is in the blocking position, the projecting blocking portion 242 goes in a moving track of the blocked portion 173 of the second subsidiary lever 17 to keep the second subsidiary lever 17 in the locked position. Meanwhile, the blocking member 24 is in the unblocking position, the blocking portion 242 goes out of the track of the blocked portion 173 of the second subsidiary lever 17 to allow the second subsidiary lever 17 to move.

At the upper part of the blocking member 24, the unlocking-contact portion 241 which can contact the engagement portion 182 of the first slide link 18 is provided. The unlocking-contact 241 contacts the engagement portion 182 owing to upward movement of the first sliding link 18 based on unlocking operation of the key cylinder 10. When the engagement portion 182 contacts the unlocking-contact portion 241, the blocking member 24 moves together with upward movement of the first sliding link 18 from the blocking position to the unblocking position. The blocking member 24 reversibly meshes with the spiral teeth 221.

The double-locking motor 22 turns in the locking direction based on the locking operation of a portable remote control switch (not shown) and turns in the unlocking direction based on unlocking operation.

When the double-locking motor 22 turns in the locking direction, the blocking member 24 is moved from the unblocking position to the blocking position. When it turns in the unlocking direction, the blocking member 24 is moved from the blocking position to the unblocking position.

Operation of the embodiment of the invention will be described.

When the Outside Handle 4 or Inside Handle 5 is Operated in the Unlocking Condition When the door latch device is in the unlocking condition in FIG. 4, the first and second locking levers 13, 15 and the first and second subsidiary levers 16,17 are in the unlocking position, and the blocking member 24 is in the unblocking position. When the outside handle 4 is operated for opening, the outer lever 8 turns in a releasing direction to allow the first and second subsidiary levers 16, 17 to move upward and to allow the releasing-contact portion 174 of the second subsdiary lever 17 to contact the opening lever 2A. Thus, the opening lever 2A turns in the releasing direction to disengage the ratchet from the latch, so that the door can be opened. When the inside handle 5 is operated for opening, the inner lever 9 turns in the releasing direction to allow the contact portion 93 of the inner lever 9 to contact the bent portion 84 of the outer lever 8, turning the outer lever 8 in the releasing direction, so that the door can be opened as well as that of the outside handle 4.

When the locking motor 21 is operated for locking in the unlocking condition, when the locking knob 6 is operated for locking and when the key cylinder 10 is operated for locking.

When the locking motor 21 is driven in the locking direction, the second locking lever 15 is driven by the locking motor 21 via the worm 211, worm wheel 23 and teeth 231. The second locking lever 15 turns on the pivot shaft 152 from the unlocking position in FIG. 4 to the locked position in FIG. 5. Turning of the second locking lever 15 is transmitted to the first subsidiary lever 16 via the projection 154 and slot 162 and to the first locking lever 13 and locking knob 6 via the link 14. Thus, the first and second subsidiary levers 16, 17, the first locking lever 13 and locking knob 6 moves together with the second locking lever 15 moves from the unlocking position to the locked position.

When the locking knob 6 is operated for locking, force of the locking knob 6 is transmitted to the second locking lever 15 via the rod 61, first locking lever 13 and link 14. The second locking lever 15 turns on the pivot shaft 152 from the unlocking position in FIG. 4 to the locked position in FIG. 5. Turning of the second locking lever 15 is transmitted to the first subsidiary lever 16 via the projection 154 and slot 162 as well as when the locking motor 21 is driven. Thus, the second locking lever 15 and first and second subsidiary lever 1, 17 are moved from the unlocking position to the locked position.

When the key cylinder 6 is operated for locking, locking operation of the key cylinder 6 is transmitted to the third key lever 20 via the first key lever 11, second key lever 12 and second sliding link 19. Turning of the third key lever 20 is transmitted to the second locking lever 15 by contacting one end of the notch 201 with the projection 155 of the second locking lever 15. As well as the above, the second locking lever 15 turns from the unlocking position to the locked position to allow the first and second subsidiary levers 16,17 to move from the unlocking position to the locked position.

When the Outside Handle 4 and Inside Handle 5 are Operated for Opening in the Locked Condition In the locked condition in FIG. 5, the locking knob 6, first and second locking levers 13, 15 and first and second subsidiary levers 16, 17 are in the locked position, and the release-contact portion 174 of the second subsidiary lever 17 is in a position which can not contact the opening lever 2A.

When the outside handle 4 is operated for opening of the door, the outer lever 8 turns in the releasing direction to allow the first and second subsidiary levers 16, 17 to move upward. The releasing-contact portion 174 which moves in a direction of an arrow C in FIG. 5 does not contact the opening lever 2A which does not turn in the releasing direction. The door cannot be opened by the outside handle 4.

The door can be opened by double actions of the inside handle 5. First, the locked state can be shifted and second the door can be opened by the inside handle 5.

Specifically, in the first door-opening operation of the inside handle 5, the inner lever 9 turns toward the releasing position with the inside handle 5 as shown in FIG. 6, the contact portion 93 of the inner lever 9 comes in contact with the bent portion 84 of the outer lever 8 to allow the outer lever 8 to move in the releasing direction and to allow the first and second subsidiary levers 16,17 to move upward. At the same time, the unlocking-contact portion 92 of the inner lever 9 comes in contact with the unlocking-contact portion 151 of the second locking lever 15 to allow the second locking lever 15 to turn toward the unlocking position. In FIG. 6, the rear edge of releasing-contact portion 174 of the second subsidiary lever 17 comes in contact with the front end of the opening lever 2A, so that the second subsidiary lever 17 stops before the unlocking position. The first subsidiary lever 16 moves together with movement of the second locking lever 15 against force of the spring 25 from the locked position to the unlocking position while the second subsidiary lever 17 remain stopped before the unlocking position.

Then, the inner lever 9 and outer lever 8 are returned to the standby position by the inside handle 5. The first and second subsidiary levers 16, 17 moves downward, and the rear edge of the releasing-contact portion 174 of the second subsidiary lever 17 leaves the front end of the opening lever 2A. The second subsidiary lever 17 is moved by the spring 25 to the unlocking position in FIG. 4. A force for holding the unlocking position of the spring 27 acting to the second locking lever 15 and first subsidiary lever 16 is greater than a force of the spring 25 acting to the first subsidiary lever 16, so that the second locking lever 15 and first subsidiary lever 16 are held in the unlocking position even when the inner lever 9 is returned to the standby position.

The door can be opened by the inside handle 5 in a similar manner in the unlocking position.

Double Locking

In the locked position, the double-locking motor 22 is rotated by a portable remote control switch, and the rotation is converted into a straight motion which is transmitted to the blocking member 24. The blocking member 24 moves from the unblocking position in FIG. 5 to the blocking position in FIGS. 2 and 3, and the blocking portion 242 goes in the track of the blocked portion 173 of the second subsidiary lever 17 to hold the second subsidiary lever 17 in the locked position and to prevent movement to the unlocking position.

In the double-locking state where the second subsidiary lever 17 is prevented from moving to the unlocking position, the locking knob 6 is unlocked, but the second subsidiary lever 17 cannot be moved to the unlocking position. It cannot be shifted to the unlocking state.

Specifically, when the locking knob 6 is unlocked in the double-locking state, unlocking force of the locking knob 6 is transmitted to the first subsidiary lever 16 via the rod 61, first locking lever 13, link 14 and second locking lever 15. The first subsidiary lever 16 moves from the locked position to the unlocking position against the force of the spring 25 acting with the second subsidiary lever 17 held in the locked position. In this state, even if unlocking force of the locking knob 6 is removed, an unlocking-position holding force of the spring 27 is greater than a force of the spring 25, so that the locking knob 6, first locking lever 13, second locking lever 15 and first subsidiary lever 16 are held in the unlocking position.

In the double-locking state, the locking knob 6 can be moved to the unlocking position against the spring 25, but the second subsidiary lever 17 which can release the engagement portion 2 cannot be moved to the unlocking position. Thus, the door cannot be opened by the outside handle 4 or inside handle 5, or double-action of the inside handle 5.

In the double locking state, the locking knob 6 can be moved to the unlocking position against the spring 25. The second subsidiary lever 17 is prevented from moving to the unlocking position. So, even if the locking knob 6 is unlocked accidentally, load is not subjected to a force-transmitting path for transmitting an unlocking force of the locking knob 6 thereby preventing deformation of parts along the force-transmitting path. Furthermore, the second subsidiary lever 17 for releasing engagement of the engagement portion 2 contacts the blocking member 24 which can move straight, and is held in the locked position thereby rendering double-locking state with simple structure. The second subsidiary lever 17 comes in contact with the blocking member 24 from a direction in which a force for moving the blocking member 24 to the unblocking position hardly act, or from a direction perpendicular to straight movement direction of the blocking member 24, thereby holding the second subsidiary lever 17 in the locked position without fail.

Double Lock Release

By unlocking with the remote control switch, the double-locking motor 22 is rotated in the unblocking direction. The rotation of the motor is transmitted to the blocking member 24 via the spiral gear 221. The block member 242 moves upward from the blocking position to the unblocking position, so that the blocking portion 242 goes out of the track of the blocked portion 173 of the second subsidiary lever 17. The second subsidiary lever 17 is released from the locked position to enable the lever 17 to move to the unlocking position. The locking motor 21 allows the second locking lever 15 to move from the locked position to the unlocking position. Thus, the locking knob 6 and first and second subsidiary lever 16, 17 moves to the unlocking position.

When the locking knob 6 is unlocked in the double-locking state to allow the first and second locking levers 13, 15 and first subsidiary lever 16 to the unlocking position, the blocking member 24 is moved from the blocking position to the unblocking position by the double-locking motor 22 to allow the second subsidiary lever 7 to move to the unlocking position by the spring 25 to shift to the unlocking state.

When the key cylinder 10 is unlocked outside the vehicle, unlocking force of the key cylinder 10 is transmitted to the first sliding link 18 and second sliding link 19 via the link 26, and the first and second key levers 11, 12. The first sliding link 18 moves upward, and the engagement portion 182 comes in contact with the unlocking contact portion 241 of the blocking member 24 in the blocking position to allow the blocking member 24 to move from the blocking position to the unblocking position. The second sliding link 19 moves upward to allow the second locking lever 15 to move from the locking position to the unlocking position via the third key lever 20. With the movement of the second locking lever 15 to the unlocking position, the locking knob 6 and first and second subsidiary lever 16, 17 move to the unlocking position to shift to the unlocking state. Thus, even if in the double-locking state, the locking motor 21 and double-locking motor 22 are out of order owing to malfunction in an electric system, the key cylinder 10 is manually operated to release the double-locking state.

The foregoing merely relates to one embodiment of the invention. Without departing from the scope of claims, various modifications and changes may be made as below:

i) A first key lever and a second key lever are integrally formed.

ii) A locking knob and a second locking lever are directly coupled to each other via a rod without a first locking lever or a link.

What is claimed is:

1. A door latch device in a motor vehicle, comprising:

an engagement portion that includes a latch which engages with a striker of a vehicle body of the motor vehicle, a ratchet which engages with the latch, and an opening lever which is rotatable with the ratchet;

an operating lever operated with an operating handle on a door to open the door;

a locking lever moving with a locking knob on the door inside the vehicle between an unlocking position where the engagement portion can be disengaged from the striker and a locked position where the engagement portion cannot be disengaged from the striker;

a first subsidiary lever moving with the locking lever between the unlocking position and the locked position;

a second subsidiary lever connected to the operating lever and moving with the first subsidiary lever between the unlocking position and the locked position, the second subsidiary lever having a releasing-contact portion which comes in contact with the opening lever of the engagement portion when the second subsidiary lever is in the unlocking position, the releasing-contact portion not coming in contact with the opening lever when the second subsidiary lever is in the locked position, wherein the operating lever, the locking lever, the first subsidiary lever and the second subsidiary lever are disposed in the same plane parallel with a longitudinal axis of the motor vehicle;

a spring exerting a force to the first subsidiary lever and the second subsidiary lever so that the second subsidiary lever follows the first subsidiary lever;

a blocking member moving between a blocking position where the blocking member comes in a track of the second subsidiary lever so that the second subsidiary lever is prevented from moving from the locked position to the unlocking position and an unblocking position where the blocking member goes out of the track to allow the blocking member to move to the unlocking position; and a blocking motor moving the blocking member between the blocking position and the unblocking position, enabling the locking lever and the first subsidiary lever to move from the locked position to the unlocking position against the force of the spring while the second subsidiary lever is still held in the locked position when the blocking member is in the blocking position.

2. The door latch device of claim 1, further comprising an elastically holding member elastically holding the locking lever and the first subsidiary lever in the locked and unlocking positions, a force of the elastic holding member being greater than the force of the spring, the locking lever and the first subsidiary lever being held in the unlocking position by the force of the elastically holding member when the blocking member is in the blocking position and when the locking lever and the first subsidiary lever moves from the locked position to the unlocking position, the blocking member moving to the unblocking position to allow the second subsidiary lever to move the unlocking position by the force of the spring.

3. The door latch device of claim 2 wherein the elastically holding member comprises a spring.

4. The door latch device of claim 1 wherein the second subsidiary lever is pivotally connected to the first subsidiary lever.

5. The door latch device of claim 1 wherein the blocking member meshes with an output shaft of the blocking motor, the output shaft rotating to allow the blocking member to move straight between the blocking position and the unblocking position.

6. The door latch device of claim 5 wherein the second subsidiary lever comes in contact with the blocking member in a direction perpendicular to a motion of the blocking member.

* * * * *